US005829158A

United States Patent [19]

Straub et al.

[11] Patent Number: 5,829,158

[45] Date of Patent: Nov. 3, 1998

[54] DRYER SECTION WITH ATTACHED DRIVE MECHANISM

[75] Inventors: Karlheinz Straub; Christian Schiel, both of Heidenheim, Germany

[73] Assignee: Voith Sulzer Papiermaschinen GmbH, Heidenheim, Germany

[21] Appl. No.: 819,903

[22] Filed: Mar. 18, 1997

[30] Foreign Application Priority Data

Mar. 20, 1996 [DE] Germany ..... 296 05 198 U

[51] Int. Cl.[6] ..... D21C 5/00

[52] U.S. Cl. ..... 34/121; 34/126

[58] Field of Search ..... 34/114, 117, 118, 34/119, 120, 121, 124, 126; 74/665 GA, 417

[56] References Cited

U.S. PATENT DOCUMENTS

| | | | |
|---|---|---|---|
| 2,219,856 | 10/1940 | Weston | 34/121 |
| 2,710,457 | 6/1955 | Cirrito et al. | 34/121 |
| 2,931,107 | 4/1960 | Sellers | 34/121 X |
| 4,181,039 | 1/1980 | Phelps | 34/121 X |
| 5,012,594 | 5/1991 | Preisetanz et al. | 34/121 |
| 5,230,169 | 7/1993 | Jaatinen et al. | 34/124 |

*Primary Examiner*—Henry A. Bennett
*Assistant Examiner*—Steve Gravini
*Attorney, Agent, or Firm*—Taylor & Associates, P.C.

[57] ABSTRACT

The invention is directed to a dryer section for an apparatus to produce a continuous material layer, such as paper, carton or cardboard. At least one dryer group has a plurality of dryer cylinders and guiding rollers. The dryer cylinders and guiding rollers carry the material layer along a meandering path, with each dryer cylinder and each guiding roller having a first side disposed on a same side of the dryer section. At least one mechanical drive mechanism is provided, with each drive mechanism being coupled with the first side of a dryer cylinder and/or guiding roller. A plurality of supply tubes are each connected with the first side of a corresponding dryer cylinder and/or guiding roller.

14 Claims, 3 Drawing Sheets

DRYER SECTION WITH ATTACHED DRIVE MECHANISM

BACKGROUND OF THE INVENTION

1. Field of the Invention

The present invention relates to a dryer section for an apparatus for the manufacture of a continuous layer of material such as paper, carton or cardboard.

2. Description of the Related Art

Machines of the above-described type are already well known (DE 39 10 612 T2). One of the most sought after improvements regarding these dryer sections is to keep their shape as compact as possible. It has become painfully obvious that this is not always an achievable goal without making serious sacrifices. One of the most common drawbacks that is encountered when keeping these dryer sections compact is that access to their functional parts is compromised, making maintenance and cleaning work very difficult.

What is needed in the art is a compact dryer mechanism which allows access for maintenance work and cleaning checks.

SUMMARY OF THE INVENTION

The present invention provides a compact dryer section with an entire supply tubing system for the dryer cylinders and/or the guiding rollers which is connected to the side of the dryer where all of the driving mechanisms and attachments are located, which will from now on be referred to as the drive side. The supply tubes are connected to the faces of the dryer cylinders and/or the guiding rollers located on the drive side. The present invention essentially results in considerable space reductions for the entire dryer section. Placing all the important supply tubing and mechanical drive connections to one side simplifies the arrangements one has to make to allow accessibility for maintenance, control checks and cleaning work.

An especially note worthy embodiment of this invention is one that features a driving mechanism with separate sets of gears for each of the dryer cylinders and/or guiding rollers. The gears can be constructed to be small and compact. It is of further advantage that the gears are to be located outside of the seating plane of the dryer section so that the seating structure on the drive side can be shaped identically to the seating structure on the opposite side, which will from now on be referred to as the tending or guided side. One of the advantages of having identical shapes of the seating structures on both sides is that it will result in equal conditions as far as air circulation and exchange is concerned. This is beneficial because it will not cause the moisture content on one side to be different from that on the other side, so there will not be any undesirable gradients across the profile of the material layer. An additional benefit results from the fact that it will be relatively easy to perform maintenance and control work, even on the drive side of the dryer section.

A particularly desirable embodiment of the dryer section includes supply tubes which are led through the drive gears, which are configured as a kind of mechanism that snaps on to the dryer cylinders and/or guiding rollers. The supply tubing in this instance has to be kept stationary. The connections of the supply tubing system to the dryer cylinders and/or guiding rollers can therefore be built in a relatively simple fashion.

Another preferable embodiment of the dryer section includes special bearings which support the stationary supply tubes along the casing of the driven dryer cylinders and/or the driven guiding rollers, respectively. Such an arrangement requires relatively little space, so that it will not impede the access to the functional components of the dryer section for maintenance and control work.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
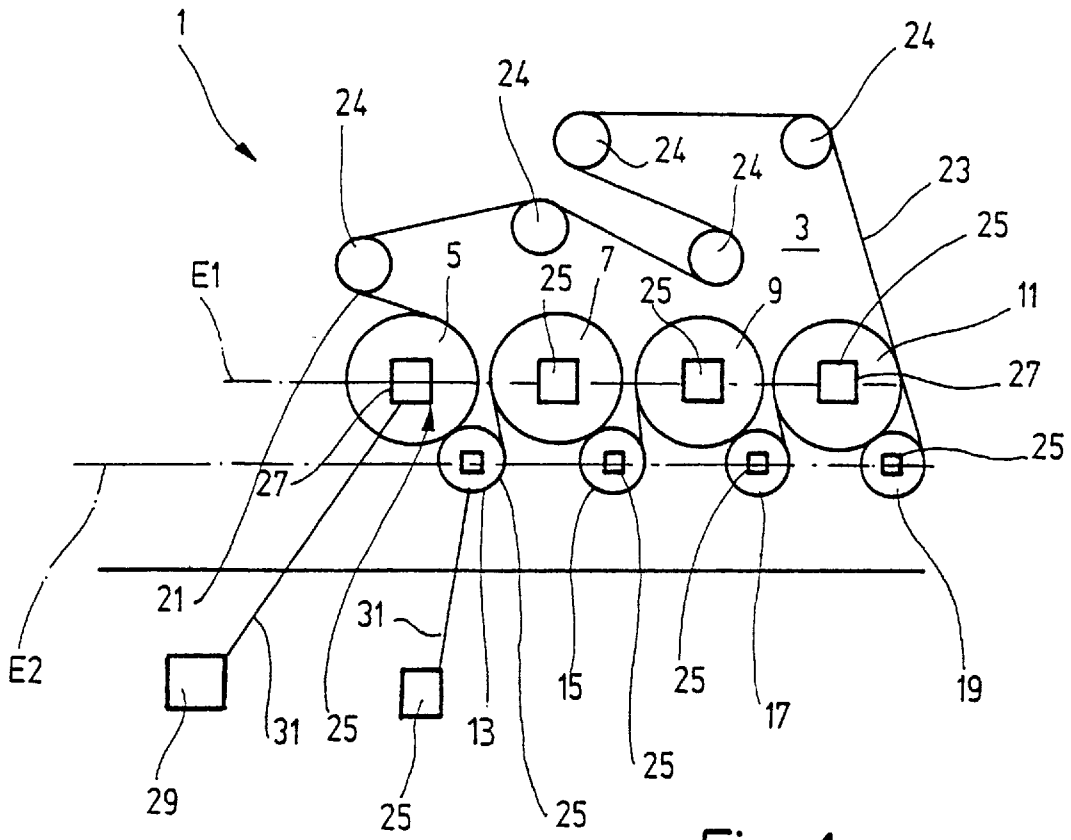
FIG. 1 is a schematic side view of a section of a dryer section.

The dryer section that is described herein can be generally applied in connection with equipment for the production of material layers. For the purposes of illustration, it is assumed that the dryer section depicted in FIG. 1 is part of an apparatus for the manufacture of paper. The material layer that is to be dried, in this case a continuous layer of paper, enters the dryer section and is lead along a meandering path around a number of dryer cylinders and guiding rollers. The dryer section can consist of one or several dryer groups, each of which includes a number of dryer cylinders and guiding rollers.

FIG. 1 depicts a segment of a dryer section in a schematic side view, namely a dryer group 3 which contains a number of dryer cylinders 5, 7, 9, and 11, whose center axes are located on a plane E1. Below these dryer cylinders are a number of guiding rollers 13, 15, 17, and 19, whose center axes are in similar fashion located on another plane E2, which is separated from the other plane E1. Guiding rollers 13 through 19 are each located in-between two adjacent dryer cylinders.

A material layer 21, which is indicated by a dashed line, is led along with a conveyer band 23 that functions as a dryer sieve or felt along the meandering path around all the dryer cylinders and guiding rollers. A number of routing rollers 24 direct conveyer band 23 from the end back to the beginning of dryer group 3.

A number of rectangles in FIG. 1 shown within the cylinders and the rollers indicate that all the dryer cylinders 5 through 11 as well as all the guiding rollers 13 through 19 can potentially have their own drive mechanisms 25. Such a drive mechanism includes a gear 27, a driver motor 29, as well as an interconnected drive belt 31. The entire drive mechanism with all its components is only shown once, i.e. with respect to the first dryer cylinder 5, to avoid making this drawing too convoluted and confusing. The drive mechanisms at the other locations are exactly the same, so each dryer cylinder and each of the guiding rollers have their own drive mechanism 25, including a gear 27, a driver motor 29, and a drive belt 31. FIG. 1 thus shows the drive side of the dryer group.

A material layer 21 is guided in-between dryer cylinders 5 through 11, making contact with the surface of a dryer cylinder on one side and conveyer band 23 on the other side. Conveyer band 23 is in contact with the surface of guiding rollers 13 through 19 while material layer 21 is on the outside, not in direct contact with the guiding rollers.

In one embodiment of the dryer section, only guiding rollers 13 through 19 have their own drive mechanisms 25. This is advantageous as the effect of the drive force in these location can be maximized, because of the intimate contact between guiding rollers 13 through 19 and conveyer band 23, without adversely effecting the continuous material layer 21, or paper, respectively.

If a separate drive mechanism is assigned to each guiding roller the local driving forces could be smallest. As the local drive forces are kept small, the local tensile forces pulling at the conveyer band are also be minimized. This, in turn, causes the least amount of stretching in the conveyer band which means that the material layer will not be exposed to any excessive deformation as it is processed.

Another configuration includes a drive mechanism which is only assigned to the last guiding roller in a dryer group. It has been determined that one drive mechanism can be enough if there is a sufficiently long contact angle between the conveyer band and the guiding roller. It has also been determined that it is possible to equip a dryer cylinder with a drive mechanism if the angle of contact between material layer 21 and the dryer cylinder is relatively small. If a guiding roller is equipped with internal suction then the angle of contact between material layer 21 and the dryer cylinder should be kept rather large if the roller is supposed to be equipped with its own drive mechanism.

An additional possible configuration, as indicated in FIG. 1, is that each dryer cylinder 5 through 11 and each guiding roller 13 through 19, even those that are equipped with an internal suction device are supplied with their own drive mechanism.

The torque and the rotational velocities of the drive mechanisms are to be controlled well enough so that a layer of steam between the material layer and the dryer cylinder, which could cause a little floating action, does not cause the material layer to slip relative to the dryer cylinder. The floating tendency is increased when the material of conveyer band 23 is not very porous, so that the steam cannot escape through conveyer band 23. The material layer is pressed against the dryer cylinder by applying tension to the conveyer band. The amount of tension is chosen such that the material layer is pressed firmly and securely against the dryer cylinder.

It is particularly simple to locate drive motor 29 of the drive mechanism 25 below dryer group 3 for an embodiment of the dryer section 1 that contains a top felted dryer group 3 such as shown in FIG. 1, meaning that the conveyer band is guided from the end of the dryer group back to the beginning above dryer cylinders 5 through 11. In this case it would be practical to attach drive motor 29 to the bottom of dryer section 1 or to the bottom of the entire apparatus for the manufacture of a continuous material layer 21 or paper, respectively.

All the supply tubes which are not specifically shown in FIG. 1, are located on the drive side of the dryer section 1, where they are connected to the side faces of the dryer cylinders and/or guiding rollers on the side where the individual drive mechanisms are mounted. The term supply tubes refers to the tubes that supply steam and air as well as all tubes that remove steam, air and condensation.

Figure 2:
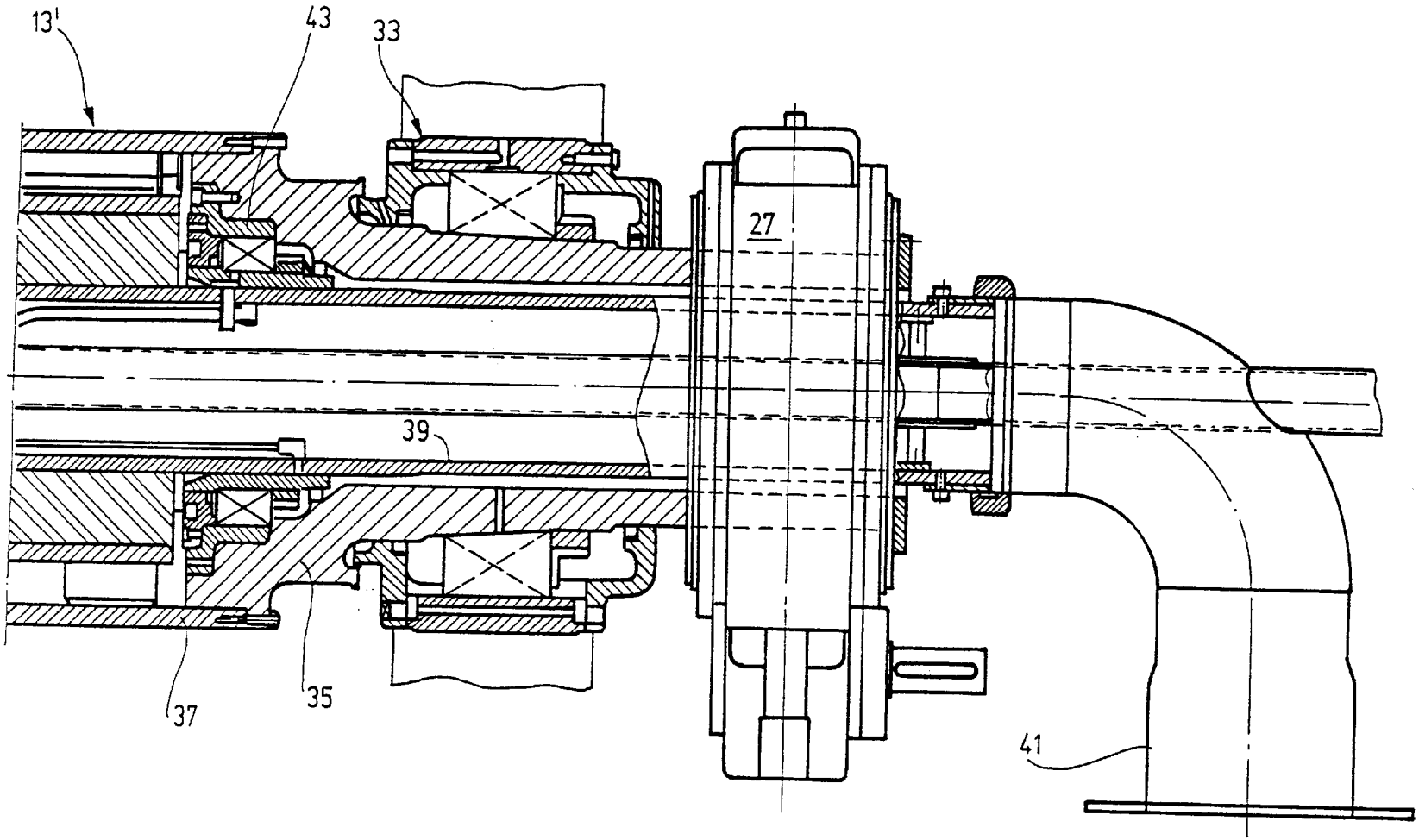
FIG. 2 is a first embodiment of the driving mechanism of a suction guiding roller.
Figure 3:
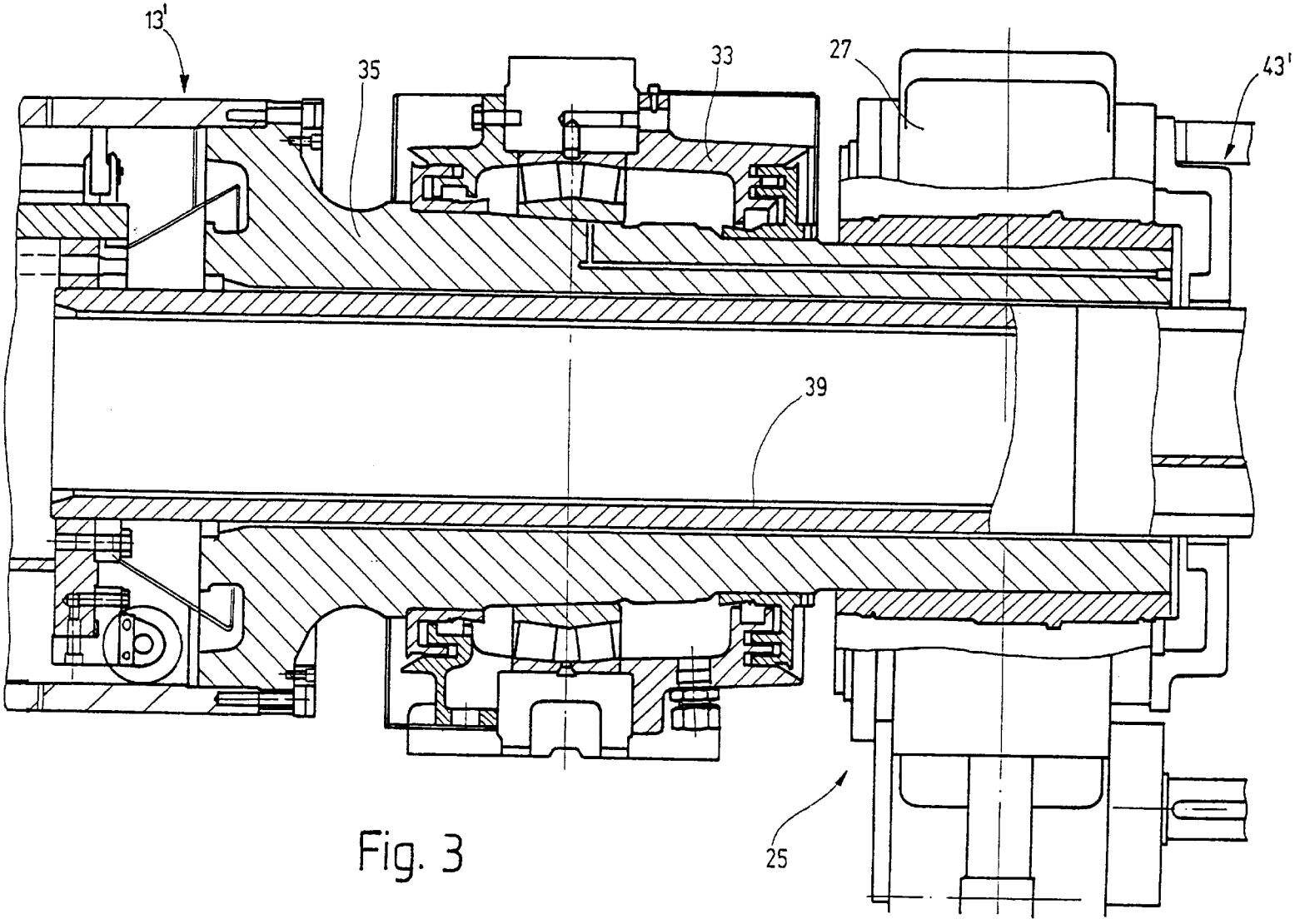
FIG. 3 is a second embodiment of the driving mechanism of a suction guiding roller.

FIGS. 2 and 3 show two embodiments where the drive force is transmitted by a gear 27, that is built to be plugged onto the casing so that it can be easily installed on and removed from the casing of a guiding roller with an internal suction device.

FIG. 2 depicts the drive side of guiding roller 13' that is equipped with an internal suction device and held by an appropriate bearing 33 in the seating structure of the apparatus for the manufacture of a continuous layer of material. A shaft butt end 35 extends through bearing 33. Gear 27, which is designed so that it can be easily plugged onto or unplugged from the side of shaft butt end 35 that is facing away from guiding roller 13', is driven by a belt that is coupled to a motor, both of which are not shown in this drawing.

As shown in the partial sectional view of FIG. 2, shaft butt end 35 is connected with casing 37 of guiding roller 13' which is equipped with an internal suction device. Hollow shaft butt end 35 is penetrated by a supply tube, in this case a neck to a suction tank, which is a connector pipe 39 that transfers the negative pressure from a pump to the interior of guiding roller 13'. Connector pipe 39 also penetrates the gear 27 and leads to a connecting branch 41 which in turn is connected with a suitable negative pressure source. FIG. 2 shows how connector pipe 39 is held in place by a suitable bearing, in this case support bearing 43, which is mounted to casing 37 or to shaft butt end 35.

The driving forces are transmitted through gear 27 to shaft butt end 35 and to casing 37 of guiding roller 13' so that roller 13' is forced to rotate. Connector pipe 39 that is mounted to guiding roller 13' is itself not participating in the rotation. Connector pipe 39 is attached to connecting branch 41 which is also stationary.

FIG. 3 shows a sectional view of a somewhat modified embodiment of guiding roller 13' which is equipped with internal suction. The reference numbers for the components in FIG. 3 are the same as the reference numbers used for the components in FIG. 2.

Guiding roller 13' with internal suction includes a shaft butt end 35 which is held in place by bearing 33 located on the seating structure of dryer section 1 or the overall seating structure of the entire apparatus for the manufacture of a continuous layer of material 21. Shaft butt end 35 extends through bearing 33 and through gear 27. Gear 27 is designed to be easily plugged and unplugged, and is part of mechanism 25 that is only partially shown in FIG. 3 and which drives guiding roller 13'. A supply tube extends through hollow shaft butt end 35, a so called neck to a suction tank which serves as a connector pipe 39 to transfer negative pressure to the interior of guiding roller 13'. Connector tube 39 is a stationary component that is held by support bearing 43' which in turn is attached to the housing of gear 27.

FIGS. 2 and 3 show that the manner in which the supply tube or connector pipe 39, respectively, are connected to the housing of guiding roller 13' that is being driven, will not interfere with the access to gear 27. It is also apparent that the available space between support bearing 33 and guiding roller 13' can be utilized very advantageously.

Support bearing 43' is mounted to the housing of gear 27, as shown in FIG. 3, and allows easy access to the support bearing which makes maintenance and repair work extremely simple. It is even a simple task to exchange the entire gear. This holds especially true when the support bearing 43' is mounted to the housing of gear 27 as opposed to being fully integrated into the housing. It is furthermore possible to use the screws that hold gear 27 together to mount the support bearing to the housing, which results in a particularly compact construction.

The details of the construction of guiding roller 13' that is equipped with internal suction as well as the construction of bearing 33, both shown in FIGS. 2 and 3, is already known. No further descriptions will be given here.

It follows from the above description that dryer section 1 may consist of several dryer groups, as shown in FIG. 1. The number of dryer cylinders and guiding rollers may also vary and should be chosen according to the requirements of a machine or the material properties of the layer that is being produced. What is significant is that the driving mechanism for dryer section 1 can be built to occupy very little space and that it can be arranged in a variety of configurations to adjust to many different situations. Those dryer cylinders that need to be driven require only relatively small gears which will be driven by motor 29, transmitted through drive belt 31. Drive motor 29 can be mounted somewhere below dryer section 1, as it is shown in FIG. 1, so that the spatial requirements are kept to a relative minimum.

If special plug-on gears are chosen for the dryer cylinders or guiding rollers it is possible to extend supply tubes through the gear and into the cylinder or roller. FIGS. 2 and 3 show guiding roller 13' that is equipped with internal suction to illustrate this concept as an example. It is apparent that one can also use supply tubes to supply steam or withdraw condensation from the interior of a dryer cylinder instead. The necessary tubes can be guided through the hollow shaft butt end and the plug-on gear. The supply tubing for dryer cylinders and guiding rollers can be attached on the drive side of the dryer section so that the entire side is kept free from supply tubing connections as well as mechanical drive attachments which simplifies access for maintenance, repair and cleaning work.

Since it is possible to assign drive mechanisms to any dryer cylinder and to any guiding roller, even those rollers that are equipped with internal suction, there is a wide range of control over the tension that is subjected to the conveyer band so that the tension can be optimally adjusted to the characteristics of the material layer that is being produced. It is furthermore possible to avoid a build up of entrapped air or steam between the material layer and the dryer cylinder, so that the material layer will not be allowed to float.

The descriptions given with reference to FIGS. 1 through 3 make it clear that the dryer section is constructed in a very compact way, since all the supply tubes, including the steam supply tubes to the dryer cylinders and the tubes that draw away condensation from there, as well as the tubes that supply and exhaust air to and from the guiding rollers with internal suction, are located on the drive side of the dryer section. The opposite or tending side does not require much space at all since connections with the drive mechanisms and supply tubes have been eliminated. Since all mechanical drive connections are kept on the drive side of the dryer section, the opposite side allows maximum accessibility for maintenance and repair work.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A dryer section for an apparatus to produce a continuous material layer, comprising:

at least one dryer group having a plurality of dryer cylinders and a plurality of guiding rollers, said dryer cylinders and said guiding rollers carrying the material layer along a meandering path, each said dryer cylinder and each said guiding roller having a first side disposed on a same side of the dryer section;

at least one mechanical drive mechanism, each said drive mechanism coupled with said first side of a corresponding one of said dryer cylinders and said guiding rollers, each said drive mechanism including a gear, a driver motor disposed remotely from said at least one dryer group and configured for driving said gear, and an elongate force transmission element interconnecting said gear and said driver motor; and a plurality of supply tubes, each said supply tube being connected with said first side of a corresponding one of said plurality of dryer cylinders and said guiding rollers.

2. The dryer section of claim 1, wherein at least one of said drive mechanisms includes a gear, and wherein said supply tube associated with said at least one drive mechanism extends through said gear and into said corresponding one dryer cylinder and guiding roller.

3. The dryer section of claim 2, wherein each said drive mechanism includes a gear.

4. A dryer section for an apparatus to produce a continuous material layer, comprising:

at least one dryer group having a plurality of dryer cylinders and a plurality of guiding rollers, said dryer cylinders and said guiding rollers carrying the material layer along a meandering path, each said dryer cylinder and each said guiding roller having a first side disposed on a same side of the dryer section;

at least one mechanical drive mechanism, each said drive mechanism directly attached to said first side of a corresponding one of said dryer cylinders and said guiding rollers, at least one said drive mechanism including a gear, each said gear being configured to be plugged and unplugged from said corresponding one of said dryer cylinders and said guiding rollers; and a plurality of supply tubes, each said supply tube being connected with said first side of a corresponding one of said plurality of dryer cylinders and said guiding rollers, at least one said supply tube being associated with said at least one drive mechanism and extending through said gear and into said corresponding one dryer cylinder and guiding roller.

5. The dryer section of claim 1, wherein each said drying cylinder and each said guiding roller includes a casing, and wherein each said driving mechanism transmits a driving force to said casing of said corresponding one dryer cylinder and guiding roller.

6. The dryer section of claim 1, wherein each said one dryer cylinder and guiding roller to which said at least one drive mechanism is coupled includes a hollow shaft butt end connected to and driven by said coupled drive mechanism.

7. The dryer section of claim 1, wherein each said supply tube is substantially stationary relative to said corresponding one dryer cylinder and guiding roller.

8. The dryer section of claim 1, wherein each said dryer cylinder and each said guiding roller includes a casing, and further comprising a plurality of support bearings, each said support bearing carrying a respective one of said supply tubes and positioning said respective one of said supply tubes relative to a corresponding one of said casings.

9. The dryer section of claim 1, further comprising a plurality of support bearings, each said support bearing carrying a respective one of said supply tubes and positioning said respective one of said supply tubes relative to a corresponding one of said drive mechanisms.

10. The dryer section of claim 9, further comprising a plurality of gears resepectively carried by said support bearings, each said gear carrying a corresponding one of said supply tubes.

11. The dryer section of claim 1, wherein at least one said elongate force transmission element comprises a belt.

12. The dryer section of claim 1, wherein each said drive mechanism includes an input shaft interconnecting said gear and said elongate force transmission element.

13. A dryer section for an apparatus to produce a continuous material layer, comprising:

at least one dryer group having a plurality of dryer cylinders and a plurality of guiding rollers, said dryer cylinders and said guiding rollers carrying the material layer along a meandering path, each said dryer cylinder and each said guiding roller having a first side disposed on a same side of the dryer section;

at least one mechanical drive mechanism, each said drive mechanism directly attached to said first side of a corresponding one of said dryer cylinders and said guiding rollers, each said drive mechanism including a rotatable drive element, a driver motor disposed remotely from said at least one dryer group and configured for driving said rotatable drive element, and an elongate force transmission element interconnecting said rotatable drive element and said driver motor; and a plurality of supply tubes, each said supply tube being connected with said first side of a corresponding one of said plurality of dryer cylinders and said guiding rollers.

14. The dryer section of claim 13, wherein said rotatable drive element comprises a gear.

* * * * *